United States Patent [19]

Kumode

[11] 4,175,361

[45] Nov. 27, 1979

[54] OPENABLE CANOPY HOUSING

[75] Inventor: Masami Kumode, Tokyo, Japan

[73] Assignee: Kiyomitsu Tanaka, Nagoya, Japan; a part interest

[21] Appl. No.: 841,838

[22] Filed: Oct. 13, 1977

[51] Int. Cl.[2] ..... L04B 1/346

[52] U.S. Cl. ..... 52/66; 52/67; 47/17

[58] Field of Search ..... 52/66, 67, 72, 64, 65; 296/155; 47/17

[56] References Cited

U.S. PATENT DOCUMENTS

| | | | |
|---|---|---|---|
| 1,861,069 | 5/1932 | Smith | 52/65 |
| 1,896,433 | 2/1933 | Windeknecht | 52/67 |
| 2,789,668 | 4/1957 | Martin | 47/17 |
| 2,942,658 | 6/1960 | Wilson | 52/66 |
| 3,028,872 | 4/1962 | Cresswell | 47/17 |
| 3,245,178 | 4/1966 | Clark | 52/65 |

FOREIGN PATENT DOCUMENTS

| | | | |
|---|---|---|---|
| 566844 | 12/1932 | Fed. Rep. of Germany | 52/67 |

*Primary Examiner*—James A. Leppink
*Assistant Examiner*—Henry E. Raduazo
*Attorney, Agent, or Firm*—Irving M. Weiner; Pamela S. Burt; Melvin Yedlin

[57] ABSTRACT

An openable canopy housing having a series of movable, telescoping transparent arched panels which form the combination roof and sides. Part of the roof of the housing is formed by a horizontal beam which runs the length of the structure. The transparent panels can be selectively opened or closed to provide a structure which can be used for indoor as well as outdoor use.

11 Claims, 10 Drawing Figures

OPENABLE CANOPY HOUSING

BACKGROUND OF THE INVENTION

1. Field of the Invention

The invention relates to openable canopy housings making, for example, sporting establishments available for indoor and outdoor use.

More particularly, the invention relates to an openable canopy housing wherein a canopy is formed by a plurality of arched panels which are movable to be closed during bad weather and opened during good weather. The same establishment can be used both outdoors and indoors by opening and closing the panels, and the utility of sporting establishments and the like is improved without being influenced by weather and season.

2. Description of the Prior Art

Generally, swimming pools are built outdoors, and many sporting establishments, such as tennis courts, are built outdoors. Such sporting establishments are not able to be used during rainy weather, and thus the frequency of their utilization is influenced by the weather. Particularly, the time of utilizing outdoor pools is limited only to the time of good weather in summer. They are thus unable to be effectively used in the light of the enormous costs spent to construct them.

On the other hand, some sporting establishments are covered with a canopy so as to be an indoor establishment. In such an indoor establishment, at the time of rainy weather, the canopy will perform its function to prevent rain from entering. In such a sporting establishment, the window area is made large to be able to accept a large amount of sunshine. However, when the sunshine strikes the window, it will be reflected or absorbed by the glass, the amount of the incident light will be reduced, and the amount of the light which can be taken in will be limited. In addition, some sports are inherently to be practiced outdoors. Only when some sports are practiced outdoors, will they be healthful sports.

A sporting establishment which is used for both outdoor and indoor use is already known. This is a swimming pool covered with a canopy free to open and close. In this structure, side walls of a fixed height are erected on both sides of the pool, and an arched canopy formed by transparent members is mounted on the upper parts of the side walls on both sides. The canopy is formed by a plurality of shelters so that the shelters are movable in the lengthwise direction of the pool. The shelters will be closed at the time of rainy weather, and will be opened at the time of good weather to have an all-weather function. However, there are problems.

First, in constructing the establishment, the two side walls must be provided opposed to each other, and the same building works and costs as of a general building are required. Further, when newly fitting the canopy to an existing sport establishment, the establishment will be limited in space for providing the side walls. It is thus difficult to additionally construct a canopy in an already constructed establishment. Further, because the establishment is surrounded by side walls on both sides, light will not be able to be incident from the sides, but will be incident only through the canopy in the upper part and the amount of the sunshine which can be taken in will be restricted. Further, even if the shelters forming the canopy are opened, because the establishment is surrounded by side walls, the people within the establishment will not feel like they are outdoors, and it will be the same as an indoor establishment in which only a part of the roof is opened.

SUMMARY OF THE INVENTION

The present invention provides an openable canopy housing having a base for the housing, and a horizontal beam which is mounted a predetermined distance above the base. A plurality of transparent arched panels are arranged on at least one side of the horizontal beam. The transparent arched panels extend at their lower ends to the base of the housing. The panels are movable in the lengthwise direction of the horizontal beam of the housing.

An object of the invention is to provide an openable canopy housing wherein a horizontal beam is extended and provided above a base, and a plurality of arched panels are arranged on the sides of the horizontal beam. The panels are extended at their lower ends to the base of the establishment, form a canopy, and are movable in the lengthwise direction of the horizontal beam.

A further object of the invention is to provide an openable canopy housing wherein an indoor establishment is made by closing the panels, and an outdoor establishment is made by opening the panels. The establishment has an all-weather utility, can be used all the year round, and the utility of a sporting establishment or the like is improved.

Another object is to provide an openable canopy housing wherein the panels are formed of a transparent material, and the greater part of the outside surface of the establishment is covered with panels. The height to the horizontal beam and the length in the vertical direction of the panel are made equal to each other so that sunshine may be incident through not only the upper part, but also the side parts. A large amount of the light may thus be taken in and, when the panels are moved to the open position, the internal establishment may be completely opened and may perform the same function as an outdoor establishment.

A further object is to provide an openable canopy housing wherein, because a plurality of panels are provided only on the sides of a horizontal beam, but only a newly constructed establishment but also an already constructed establishment can be made an indoor establishment.

A further object is to provide an openable canopy housing wherein the curvature radii of arched panels are varied in accordance with the order of the panels arranged in the lengthwise direction of the horizontal beam so that when the panels are moved to the open position they may overlap with each other and be stowed in a small space.

Another object is to provide an openable canopy housing wherein walls arched the same as panels are provided in the end parts of a horizontal beam so that the panels may be stowed overlapped on the walls to completely open the internal establishment.

A further object is to provide an openable canopy housing wherein rollers are fitted to the upper and lower ends of panels, and rail members engaging with said respective rollers are secured to the base of the establishment and an elevated horizontal beam so that the rollers may roll on rail members. The panels may move in the lengthwise direction of the horizontal beam to provide a smooth panel movement by the running of the rollers.

Another object is to provide an openable canopy housing wherein an upper rail member is a channel member having a bottom plate and a side plate and raised plate formed on both sides of the bottom plate. Upper rollers are made to run in a groove formed in the channel member so that, when the panels are moved, the upper rollers are guided by the raised plates and are prevented from being run off the upper rail member, and the panels may move positively along the upper rail member.

A further object is to provide an openable canopy housing wherein a supporting member on which an upper roller is carried is further provided with a horizontal roller at right angles with the upper roller. When the panel moves, the horizontal roller rotates while in contact with the side plate of the upper rail member, and the fall of the arched panel toward the horizontal beam may be supported by this horizontal roller.

A further object is to provide an openable canopy housing wherein a plurality of upper rail members for panels are arranged stepwise as inclined with respect to the vertical direction so as to expand upwardly so that the rail member for the outermost panel is positioned in the uppermost position in accordance with the overlapping order of the panels. The upper positioned rail members project sidewise out of the lower positioned next rail members to function as covers to prevent rain from leaking in during rainy weather.

Another object is to provide an openable canopy housing wherein panels are provided with engaging members connecting the panels with each other when the panels are moved. When a specific panel is moved, the other panels move in series, and thus the opening and closing operations are simplified.

Another object is to provide an openable canopy housing wherein the panels are arranged on both sides of a horizontal beam. The internal establishment is covered with panels forming a substantially semicircular canopy so that the housing may be applied to an establishment of a comparatively large area.

A further object is to provide an openable canopy housing wherein panels are arranged only on one side of a horizontal beam, and ths shape of the canopy is quadrantal so that the housing may be applied to an establishment of a comparatively small area.

DETAILED DESCRIPTION

Figure 1:
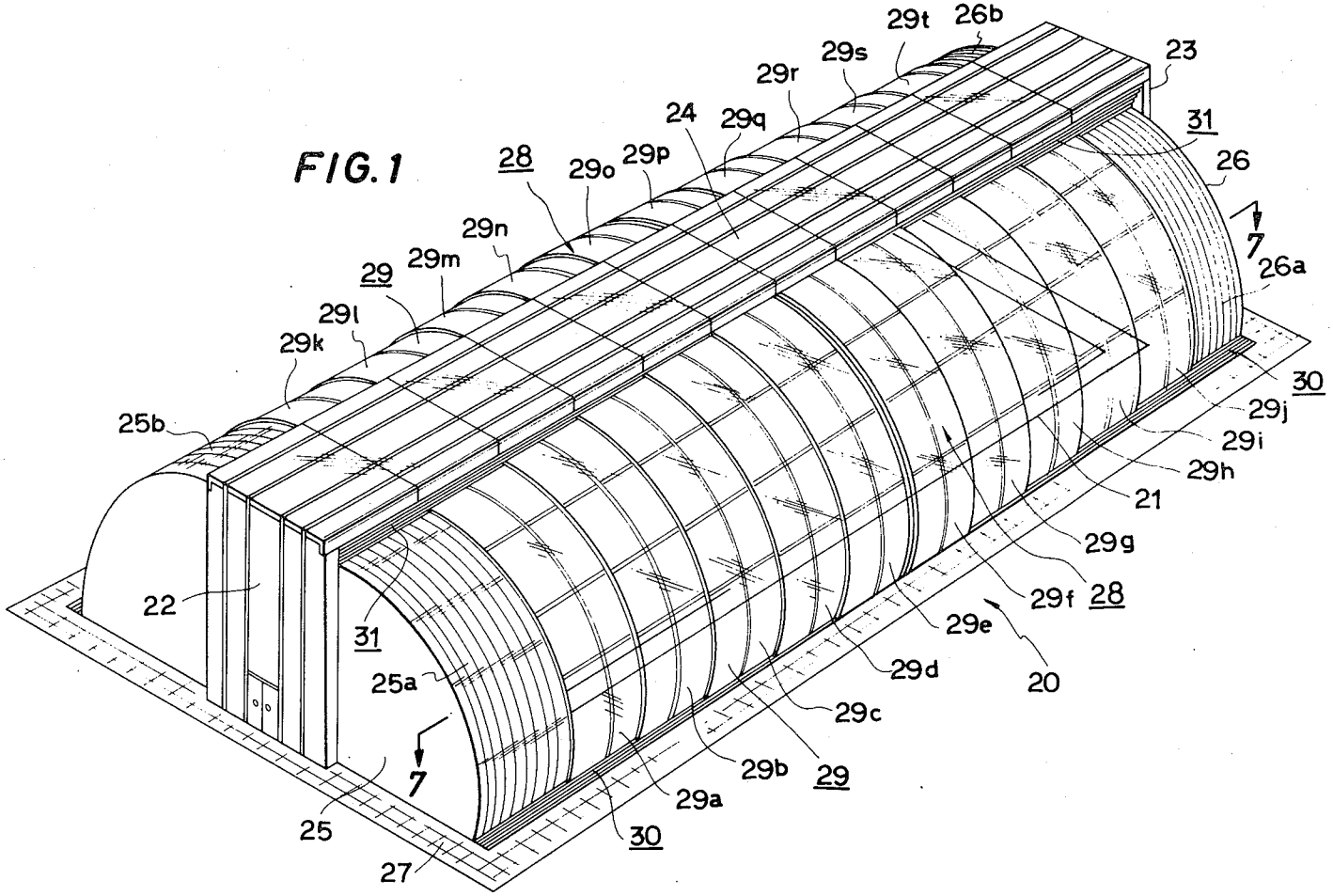
FIG. 1 is a general perspective view showing the panels as closed.

An openable canopy housing shown in FIG. 1 is formed of substantially semicircular shapes extended in the lengthwise direction, and a swimming pool 21 is provided within the housing. Stays 22 and 23 are erected in the front and rear, respectively, of housing 20. A horizontal beam 24 is mounted on stays 22 and 23 to be a basic beam. A front wall 25 and rear wall 26 are formed at the front and rear ends, respectively, of beam 24, and have extension walls 25*a*, 25*b*, 26*a* and 26*b* in the lengthwise direction of the housing to stow panels 29 described below. Walls 25*a* and 26*a* are provided on the right of beam 24, and the walls 25*b* and 26*b* are provided on the left of beam 24. Walls 25*a*, 25*b*, 26*a* and 26*b* are formed to be symmetrical in the lengthwise and lateral directions of housing 20, and are arched by the same curvature radius outside the housing. Beam 24 and stays 22 and 23 are formed by fitting outer fitting members to general building steel members. Walls 25, 26, 25*a*, 25*b*, 26*a* and 26*b* are formed by fitting, for example, steel sheets to framework steel members.

Both side parts of housing 20, except the walls 25*a*, 25*b*, 26*a* and 26*b*, are opened from a base 27 to beam 24 to fit openable canopies 28 in the opened parts. Canopies 28 are provided on both sides of beam 24, and are formed on twenty panels 29 of equal width. Panels 29*a* to 29*j* of panels 29 are arranged on the right side of housing 20, and panels 29*k* to 29*t* are arranged on the left side of housing 20. The panels are free to move in the lengthwise direction of beam 24. Panels 29*a* to 29*e* and 29*k* to 29*o* are free to move forwardly, and panels 29*f* to 29*j* and 29*p* to 29*t* are free to move rearwardly. Such movement is guided by lower rails 30 laid on base 27, and upper rails 31 fitted to the sides of beam 24. When the panels 29 are moved to predetermined positions to be closed, then canopies 28 will be closed as shown in FIG. 1 and housing 20 becomes an indoor establishment. When panels 29 are opened, then canopies 28 will be opened as shown in FIG. 2 and housing 20 becomes an outdoor establishment.

Figure 2:
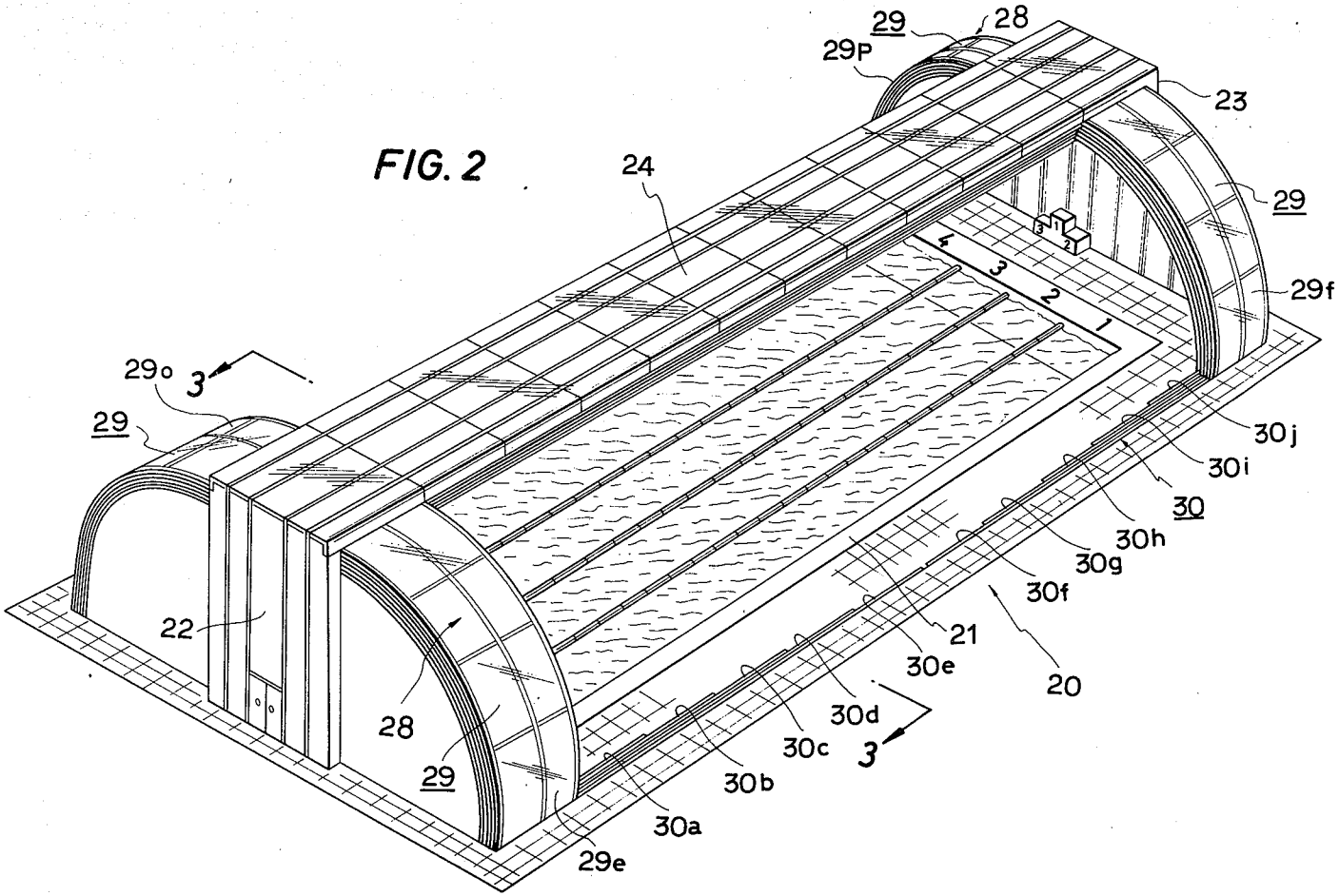
FIG. 2 is a general perspective view showing the panels as opened.
Figure 4:
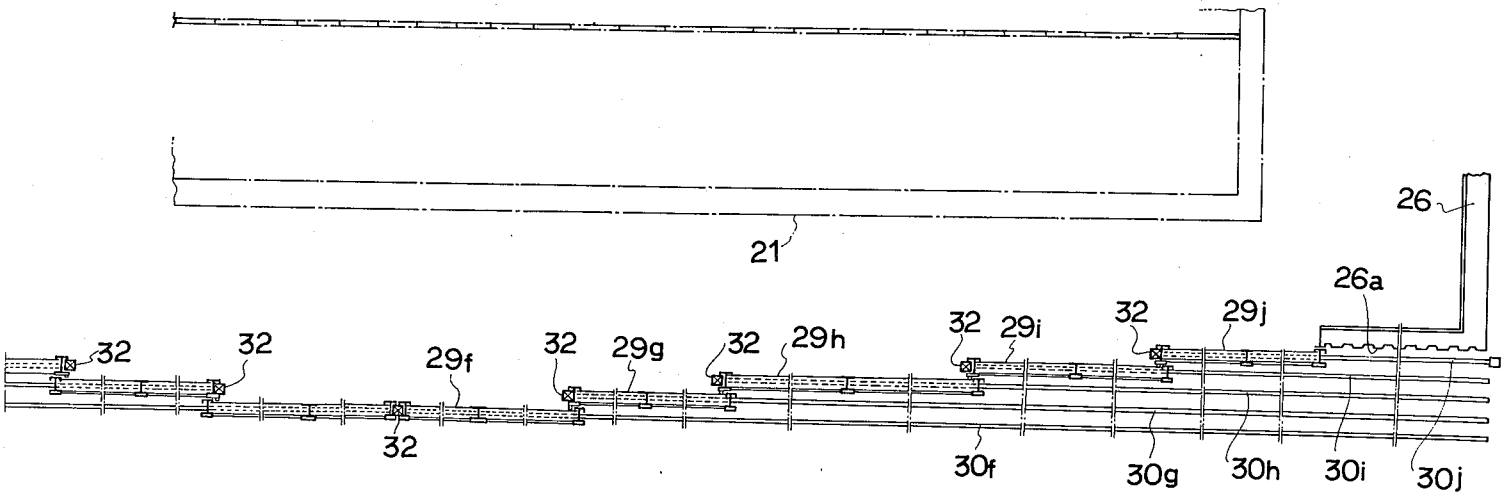
FIG. 4 is a plan view showing lower rails.

As shown in FIG. 2, panels 29*a* to 29*t* are formed so as to move on lower rails 30*a* to 30*t* (only lower rails 30*a* to 30*j* are shown in FIG. 2). Rails 30*a* to 30*j* extend the same at their base ends to walls 25*a*, 25*b*, 26*a* and 26*b*, but are different at their forward ends. The outermost rails 30*e* and 30*f* are provided as extended to the middle of housing 20. Rails 30*d* and 30*g* second from the outermost rails are shorter than rails 30*e* and 30*f* by the width of a panel 29. Rails 30*c* and 30*h* third from the outermost rails are shorter than rails 30*d* and 30*g* by the width of a panel 29. In the same manner, rails 30*a*, 30*b*, 30*i* and 30*j* are shorter in turn by the width of a panel 29. Thus, the distance in which each of the panels 29*a* to 29*t* can move is limited. The moving limits of panels 29 are regulated by securing stoppers 32 at the forward ends of rails 30 as shown in FIG. 4.

When the canopy is to be closed, panels 29 will move to stoppers 31, and will be parallelly arranged as stepped to cover housing 20 and thus make it an indoor establishment. Panels 29*a* to 29*e* and panels 29*f* to 29*j* (or panels 29*k* to 29*o* and panels 29*p* to 29*t*) will respectively move in directions reverse to each other to open or close canopy 28 so that canopy 28 may be opened in both directions from the middle in the lengthwise direction of housing 20. With canopies 28 openable in both directions and having thus a total of ten panels 29 arranged on each side of housing 20, a sporting establishment of a length ten times as large as the width of a single panel 29 will be able to be provided within housing 20. Thus, a long large sporting establishment, such as a swimming pool 21, will be able to be made an indoor establishment.

Figures 3, 8:
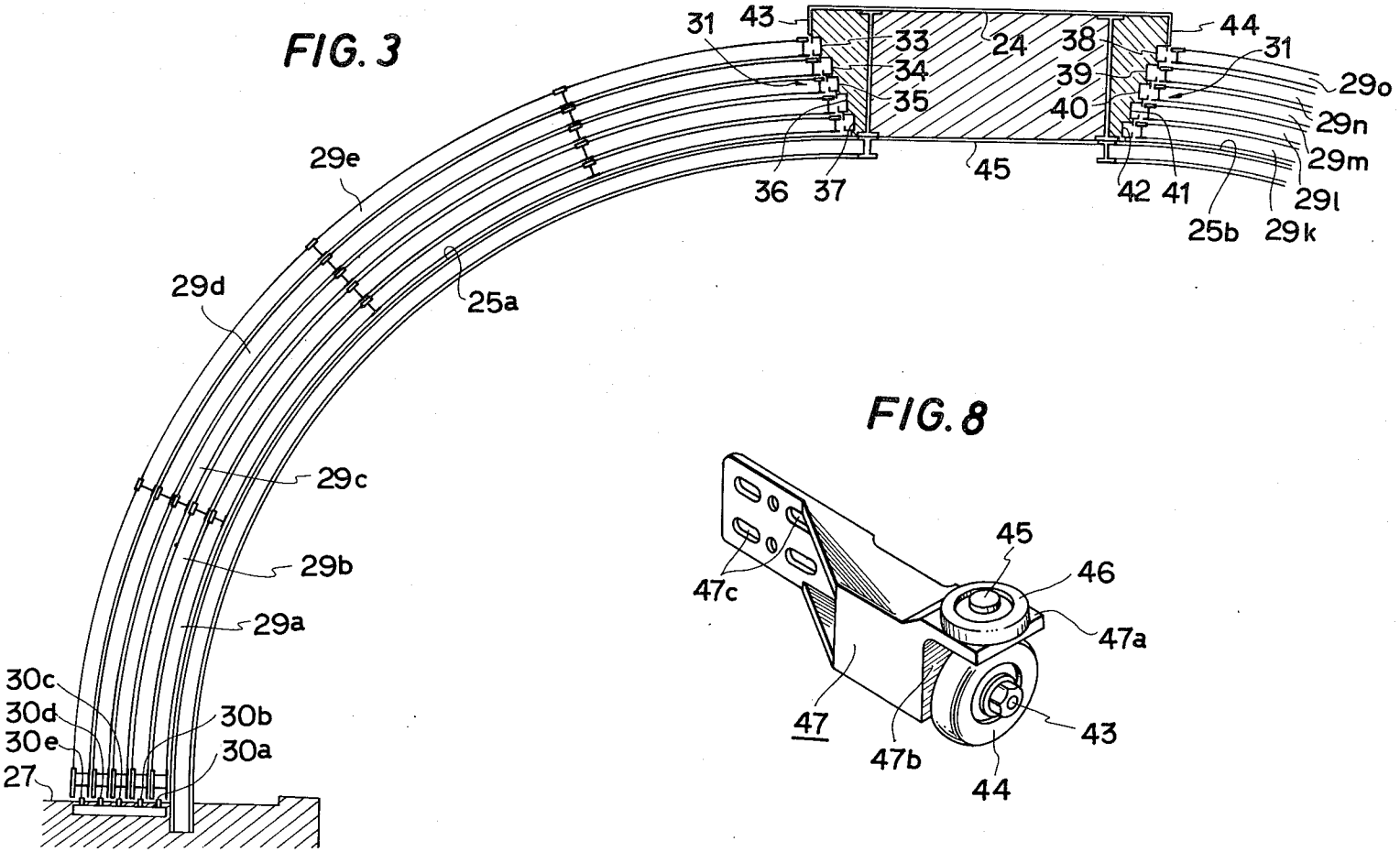
FIG. 3 is a sectioned view taken along line 3—3 in FIG. 2 showing the panels overlapped with each other.
FIG. 8 is a perspective view of a supporter holding an upper roller and a horizontal roller.

Panels 29 are formed arched and substantially quadrantal. However, as shown in FIG. 3, the curvature radii of panels 29*a* to 29*e* are respectively different. The curvature radius of the outermost panel 29*e* is made the largest, that of the panel 29*d* second from the outermost panel is made the second largest, and the curvature radii of panels 29*a* to 29*e* are made smaller in turn from the outer one to the inner one. The differences of the curvature radii apply also to panels 29*f* to 29*t*. As shown in FIG. 2 when panels 29 are moved to the ends of housing 20 to open canopies 28, the panels 29 will overlap each other in the inward and outward directions to ensure the opening of the sporting establishment. The curvature radius of innermost panel 29*a* is larger than the curvature radius of wall 25*a*. As a result, panel 29*a* may also overlap with wall 25*a*. All the panels 29 formed to be of the same width may be stowed in the respective wall 25*a*, 25*b*, 26*a* and 26*b*. When canopies 28 are opened, all the surface area closed by the panels when the canopies are closed will be opened, and the pool within the housing will be fully opened.

As shown in FIG. 3, five rails 33 to 42 of upper rails 31 are arranged on each side of beam 24, and are provided as extended to each end part of beam 24. Uppermost upper rails 33 and 38 are projected to be outermost of beam 24, and second uppermost upper rails 34 and 39 are next projected. Upper rails 33 to 37 and upper rails 38 to 42 are not arranged in the vertical direction but are projected on the sides of beam 24 in turn from lowermost upper rails 37 and 42 to uppermost upper rails 33 and 38. As a result, rails 31 diverge upwardly with respect to a vertical line so that panels 29 may overlap with each other in the horizontal direction in their upper part, and prevent leaks during rainy weather. The cross-section of beam 24 is made an inverted trapezoidal shape to conform to the arrangement of rails 31. Upper end sides 43 and 44 of beam 24 project out beyond lower end sides 45 so that upper end sides 43 and 44 form a cover to further effectively prevent rain leaks.

Ten panels 29 are arranged on the right and left sides of housing 20. Two panels 29 are engaged with each of the upper rails 33 to 42 to movably support the panels opening and closing forward and rearward of the housing.

Figure 5:
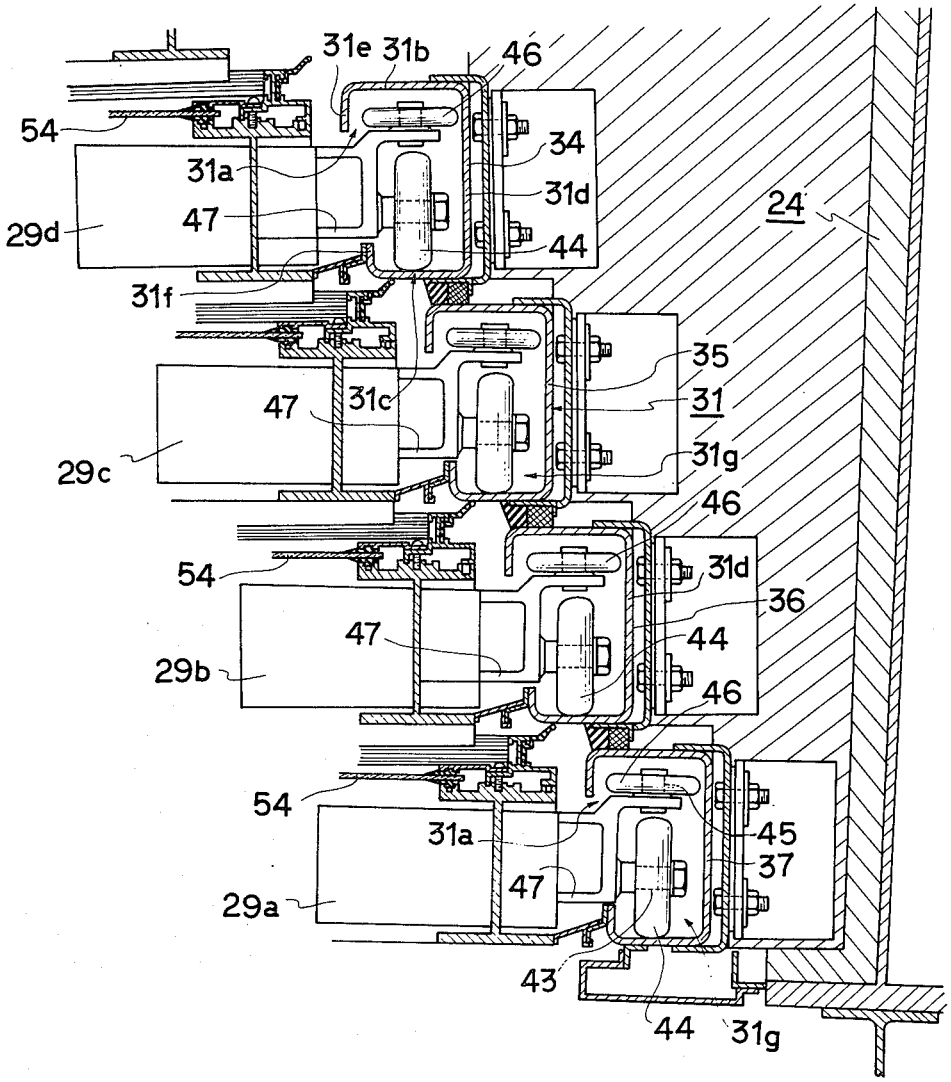
FIG. 5 is a partial magnified view of FIG. 3 showing upper rails and upper rollers engaged with each other.

As shown in FIG. 5, channel members are used for rails 31. Such channel members 31 are fitted to beam 24 horizontally so that openings 31*a* are positioned sidewise. Each of the upper rails consists of an upper plate 31*b*, lower plate 31*c*, and side plate 31*d*. Raised plates 31*e* and 31*f*, bent for a predetermined length toward the opening 31*a*, are formed at the ends of plates 31*b* and 31*c*, respectively, so that the upper rails may be substantially C-shaped. An upper roller 44 rotatably pivoted on a horizontal shaft 43 is fitted to the upper end of each of the panels, and is engaged with a groove 31*g* in the rail 31 to be rollable in the lengthwise direction of rail 31. A horizontal roller 46 is fitted rotatably on a vertical shaft 45 at the upper end of each panel to be at right angles to roller 44.

Roller 44 and 46 are fitted to a supporting member 47 shown in FIG. 8. Shaft 45 is fixed to an upper plate 47*a*, and shaft 43 is fixed to a side plate 47*b*. Member 47 is screwed and fastened integrally to the panel 29 by inserting screws into screw holes 47*c*.

Figure 6:
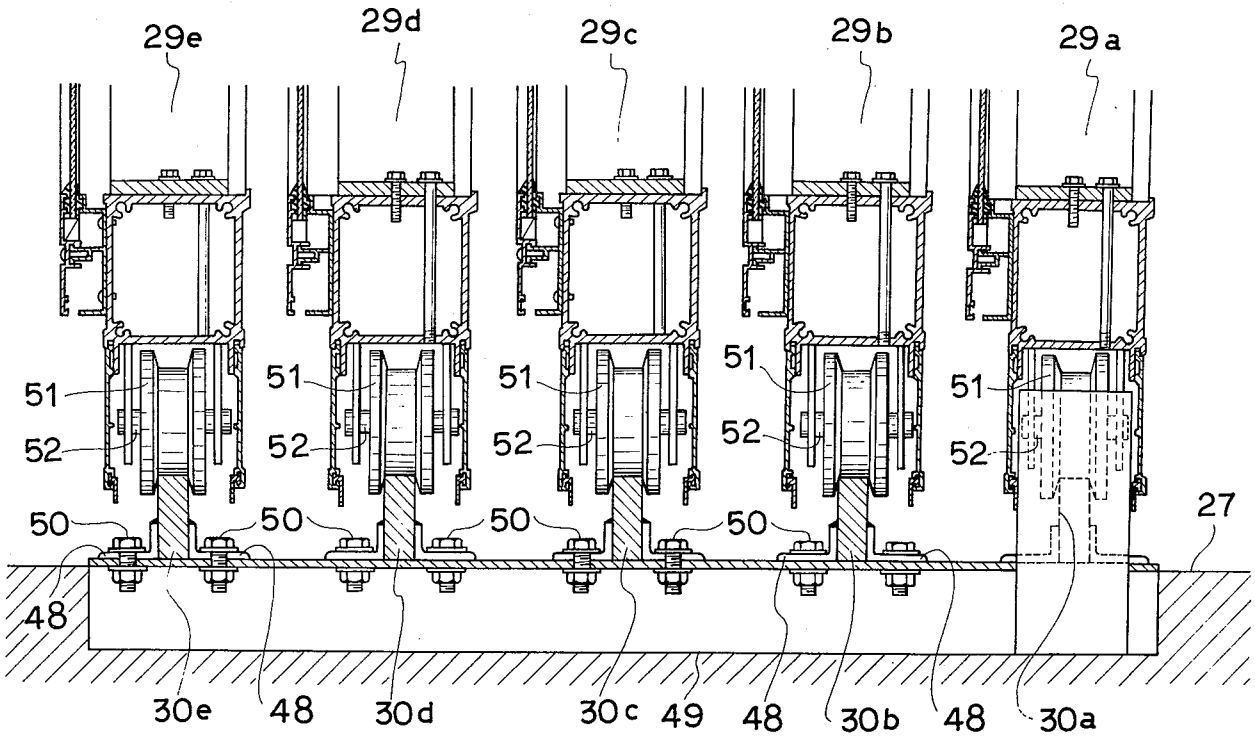
FIG. 6 is a partial magnified view of FIG. 3 showing lower rails and lower rollers engaged with each other.

As shown in FIG. 6, lower rails 30 are fitted to base 27 by being welded to angle members 48 that are secured by being screwed with screws 50 to a member 49 embedded in base 27. A lower roller 51 is fitted by being rotatably pivoted to a shaft 52 at the lower end of each panel, and is engaged with rail 30 to be rollable in the lengthwise direction of rail 30. Each panel 29 will be moved smoothly by the running rollers 51 and 44 engaged with rails 30 and 31. Because each panel 29 is arched, a fall of the panel toward beam 24 will occur but will be supported by the contact of roller 46 with plate 31*d* as shown in FIG. 5. When panel 29 moves, the roller 46 will rotate while in contact with plate 31*d*, and therefore the smooth movement of panel 29 will be assured.

Rollers 44 and 46 will be guided by plates 31*e* and 31*f*, will move along rail 31, and will be prevented by plates 31*e* and 31*f* from separating from rail 31.

Figure 7:
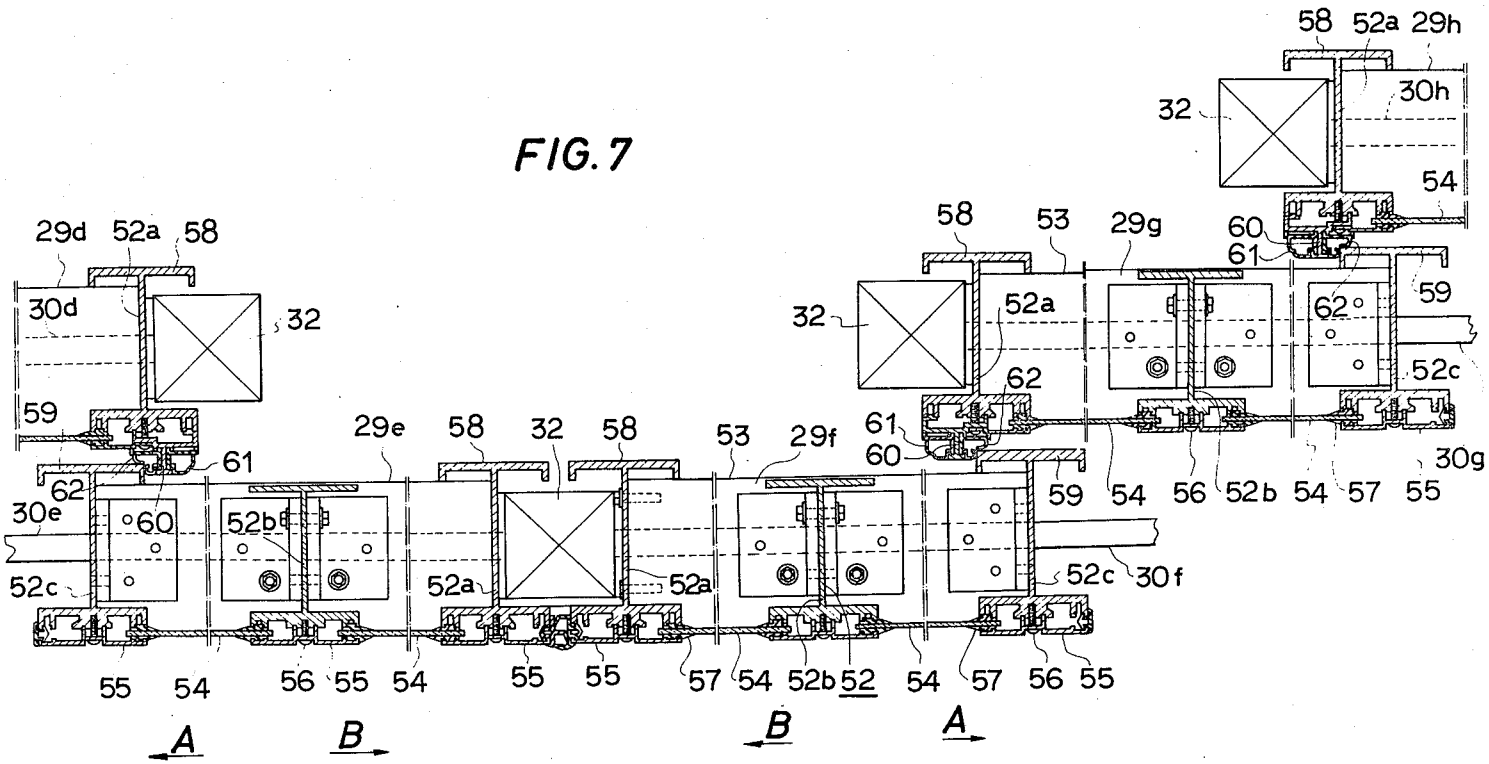
FIG. 7 is a sectioned view taken along line 7—7 in FIG. 1 showing the formation of the panels.

As shown in FIG. 7, each panel 29 is formed by combining vertical frames 52 and horizontal frames 53, and uses three vertical frames 52*a*, 52*b* and 52*c*. A transparent plate 54 formed of strengthened glass or plastic material is fitted to the outside surface side of each of the longitudinal frames 52*a* to 52*c*. Plate 54 is pressed and fitted by pressing pressing plates 55 to frame 52 with bolts 56. A packing 57 is interposed between pressing plate 55 and frame 52 so that plates 54 are watertightly fitted to panels 29 by packings 57. Because plates 54 are fitted to all the panels, and each panel 29 has a length in the vertical direction from base 27 to beam 24, sunshine will come into the sporting establishment even through the upper and side parts and a large amount of light will be able to be taken in.

Frames 52*a* and 52*c* positioned on both sides are projected inwardly of housing 20 more than middle frame 52*b* to form butts 58 and 59. Catches 60 projecting outward of housing 20 are formed on all panels 29 except panels 29*e*, 29*f*, 29*o* and 29*p*. Cushion members 61 and 62 formed of an elastic material are secured to both sides of catches 60. When panels 29*e* and 29*f* are moved in the direction of the arrow A in FIG. 7 to open canopy 28, the butts 58 will butt against catches 60 of panels 29*d* and 29*g* and two panels 29*e* and 29*d* (or panels 29*f* and 29*g*) will move together in the direction of arrow A. Butts 58 and catches 60 will likewise butt against each other in each adjacent panel 29, and the five panels 29*f* to 29*j* (or panels 29*e* to 29*a*) arranged in the lengthwise direction of housing 20 will move in series in the direction of arrow A. Therefore, by only moving the panels 29*e* and 29*f* in the direction of arrow A, the other panels 29 will be moved connected with each other to the extension walls 25*a* and 26*a*.

When panels 29*e* and 29*f* are moved in the direction indicated by the arrow B to close canopy 28, the other butts 59 will contact catches 60 of panels 29*d* and 29*g* and, in the same manner, the two panels 29*e* and 29*d* (or panels 29*f* and 29*g*) will move together in the direction of arrow B. This contact will be made in each of panels 29, and the panels will be connected with each other. Even when canopy 28 is closed, by only moving the specific panels 29*e* and 29*f* in the direction of arrow B, this operation will be able to be attained.

Because housing 20 can be constructed by erecting stays 22 and 23 in the front and rear and mounting beam 24 on stays 22 and 23, the housing 20 can be easily newly assembled on an existing sporting establishment.

Thus, it is not always necessary to simultaneously construct the sporting establishment and housing 20. Further, the panels 29 forming canopy 28 can be assembled as units in a factory, and then transported to a working site and erected.

Figure 9:
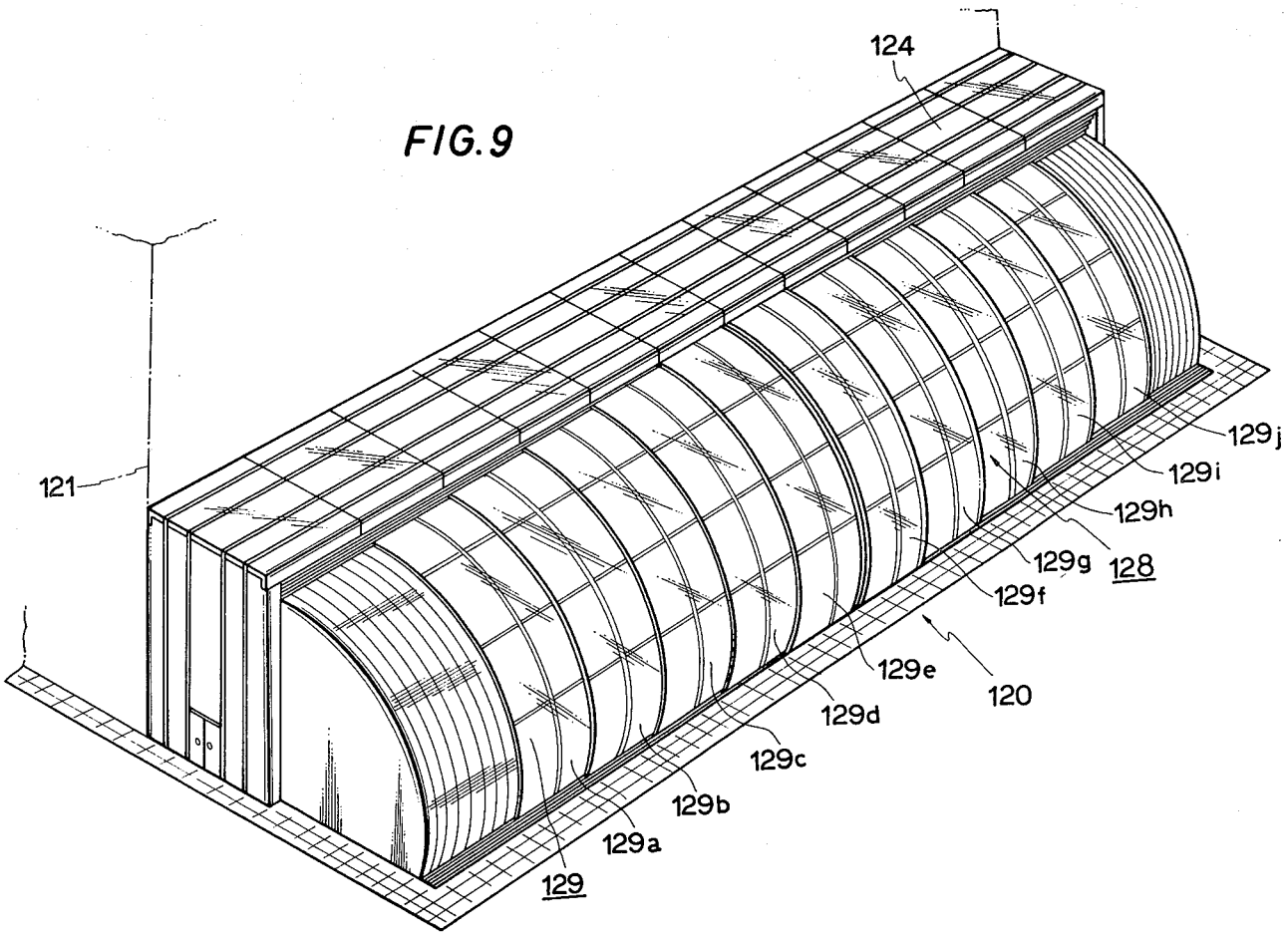
FIG. 9 is a general perspective view showing an embodiment wherein panels are arranged only on one side of a horizontal beam.

FIG. 9 shows a housing 120 of another embodiment. Housing 120 is provided with a canopy 128 only on one side of a horizontal beam 124. Canopy 128 is formed by ten panels 129, and is made to be opened in both forward and rearward directions in the part of jointing panels 129*e* and 129*f* in the middle, the same as in housing 20 of the above described embodiment. Thus, it is not necessary to arrange panels 129 always on both sides of beam 124. Housing 120 is adapted to a sporting establishment which is short in the width direction, and comparatively long in the length direction. Further, as shown in FIG. 9, it is adapted to a sporting establishment provided adjacent to a building 121. By connecting beam 124 directly with building 121, the canopy is formed only on one side of beam 124.

Figure 10:
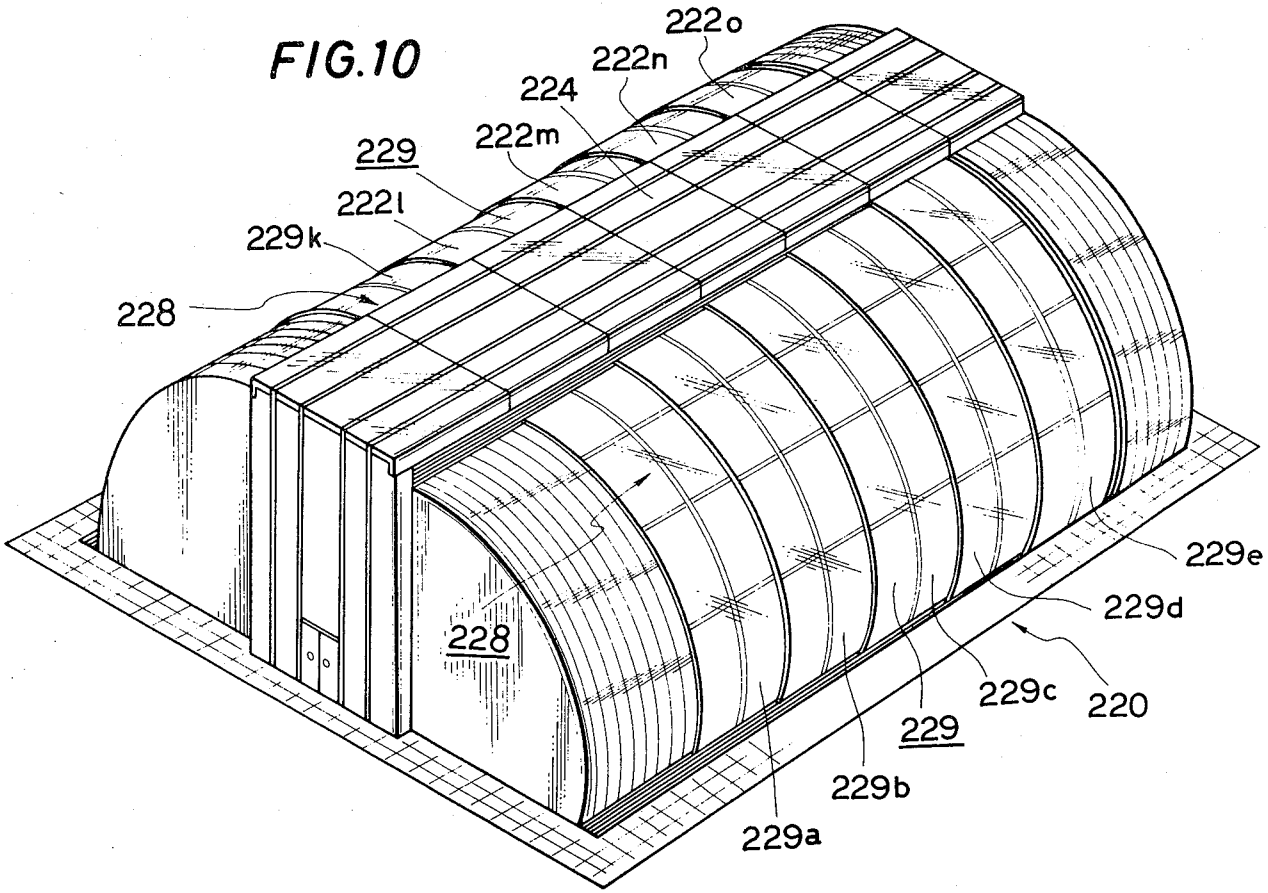
FIG. 10 is a general perspective view showing an embodiment wherein unidirectionally openable panels are employed.

FIG. 10 shows a housing 220 of a further embodiment. In housing 220, ten panels 229 are arranged on both sides of a horizontal beam 224 to form canopies 228. Housing 220 has a length substantially half that of housings 20 and 120. Five panels 229*a* to 229*e* or 229*k* to 229*o* arranged on each side of beam 224 move only in the forward direction of housing 220 to open a sporting establishment. Canopies 228 constitute a unidirectionally opening system. Housing 220 is adapted to a sporting establishment comparatively long in the width direction and comparatively short in the length direction.

In housings 20, 120 and 220, at the time of bad weather, the canopies 28, 128 and 228 will be closed so that the internal establishments may be used as indoor establishments and, at the time of good weather, the canopies will be opened so that the establishments may be used as outdoor establishments. Even in winter, if canopies 28, 128 and 228 are closed, sports will be able to be practiced therein. In case the sporting establishment is a swimming pool, if a water warming apparatus is installed, swimming will be able to be practiced all year round.

I claim:

1. An openable canopy housing comprising:

a base for said housing;

a horizontal beam mounted a predetermined distance above said base of said housing;

said horizontal beam having a major longitudinal axis;

a plurality of transparent arched panels arranged on both sides of said horizontal beam;

said plurality of transparent arched panels being extended at their lower ends to said base of said housing;

said plurality of transparent arched panels being movable parallel to said major longitudinal axis of said horizontal beam of said housing;

said transparent arched panels being arranged in the direction of said major longitudinal axis of said horizontal beam; and said transparent arched panels having radii of curvature varying in accordance with the order of arrangement of said transparent arched panels so that when said panels are moved in the direction of said major longitudinal axis of said horizontal beam, said panels will overlap each other.

2. An openable canopy housing according to claim 1, including:

containing walls arched in the same direction as said panels, and connected to said horizontal beam to contain said panels when said panels are overlapped with each other to open said housing.

3. An openable canopy housing according to claim 1, including:

a plurality of upper rectilinear rail members provided on the sides of said horizontal beam;

a plurality of lower rectilinear rail members provided on said base and extended in the panel moving direction; and upper rollers fitted to the upper ends of said panels are engaged with said upper rail members, and lower rollers fitted to the lower ends of the panels are engaged with said lower rail members to make said panels movable.

4. An openable canopy housing according to claim 3, wherein:

said upper rail members are channel members.

5. An openable canopy housing according to claim 4, wherein:

horizontal rollers are fitted to the upper ends of said panels adjacent said upper rollers, and are contacted with side plates of said channel members to prevent said arched panels from falling toward said horizontal beam; and locking plates extending in the vertical direction are formed in the opening part of said channel member to prevent said horizontal roller and upper roller from separating from said channel member.

6. An openable canopy housing according to claim 5, wherein:

said upper roller and horizontal roller are rotatably pivoted to the same supporting member fitted to said panel.

7. An openable canopy housing according to claim 3, wherein:

the arrangement positions of said upper rail members are inclined with respect to a vertical line so that said upper rail members are arranged to expand upwardly with respect to said vertical line.

8. An openable canopy housing according to claim 1, wherein:

locking parts are formed on said panels so that when the panels are moved said locking parts may contact each other to integrally move the plurality of adjacent panels.

9. An openable canopy housing according to claim 1, wherein:

said plurality of panels are made to move in the forward and rearward directions of said horizontal beam from a panel in the middle so as to open in both directions.

10. An openable canopy housing according to claim 1, wherein:

said plurality of panels are made to move in one lengthwise direction of said horizontal beam so as to open in only one direction.

11. An openable canopy housing according to claim 1, wherein:

said horizontal beam and panels are made to be assembled on an existing establishment.

* * * * *